US009478120B2

(12) United States Patent
Rothkopf et al.

(10) Patent No.: US 9,478,120 B2
(45) Date of Patent: Oct. 25, 2016

(54) SYSTEM FOR MONITORING EVACUATION OF A FACILITY

(71) Applicant: Restranaut Limited, Oxfordshire (GB)

(72) Inventors: Stephen Jaros Rothkopf, Oxfordshire (GB); Rafal Stanislaw Szabelski, Oxfordshire (GB); James Edward Anderson, Oxfordshire (GB)

(73) Assignee: Restranaut Limited of Oxfordshire (GB)

( * ) Notice: Subject to any disclaimer, the term of this patent is extended or adjusted under 35 U.S.C. 154(b) by 0 days.

(21) Appl. No.: 14/426,088

(22) PCT Filed: Sep. 4, 2013

(86) PCT No.: PCT/GB2013/052310
§ 371 (c)(1),
(2) Date: Mar. 4, 2015

(87) PCT Pub. No.: WO2014/037711
PCT Pub. Date: Mar. 13, 2014

(65) Prior Publication Data

US 2015/0228183 A1 Aug. 13, 2015

(30) Foreign Application Priority Data

Sep. 4, 2012 (GB) ..... 1215760.8

(51) Int. Cl.
*G08B 1/08* (2006.01)
*G08B 25/10* (2006.01)
(Continued)

(52) U.S. Cl.
CPC ..... *G08B 25/10* (2013.01); *G08B 21/22* (2013.01); *G07C 9/00* (2013.01)

(58) Field of Classification Search
CPC ..... G08B 25/10; G08B 21/22; G07C 9/00
See application file for complete search history.

(56) References Cited

U.S. PATENT DOCUMENTS

2004/0140899 A1 7/2004 Bouressa
2004/0203561 A1* 10/2004 Jakubowski ..... H04W 24/00 455/404.1

(Continued)

FOREIGN PATENT DOCUMENTS

GB 2 422 937 A 8/2006
WO 2007/019611 A1 2/2007

OTHER PUBLICATIONS

PCT International Search Report and Written Opinion, PCT International Application No. PCT/GB2013/052310, dated Nov. 20, 2013.

(Continued)

*Primary Examiner* — Erin File
(74) *Attorney, Agent, or Firm* — McDonnell Boehnen Hulbert & Berghoff LLP

(57) ABSTRACT

A method of monitoring the presence of personnel within a facility (S) and of monitoring the evacuation of the facility. A personnel registration system (2, 2*a*, 2*b*, 4) obtains data indicating the presence of a person. An interface computer (6) continuously receives data about people at the facility from a personnel server, and continuously supplies data to a monitoring server (9). A portable device (10*a*, 10*b*, *c*) is in data communication with the monitoring server and continuously receives data from the monitoring server. Upon evacuation of the facility, the portable device is taken to a mustering point (A, B, C) outside of the facility, and communicates (10) wirelessly with the monitoring server and continuously receives data from and sends data to the monitoring server. During evacuation of the facility the portable device logs the attendance of people at the mustering point and continuously communicates information to the monitoring server about people logged.

24 Claims, 2 Drawing Sheets

(51) Int. Cl.
*G08B 21/22* (2006.01)
*G07C 9/00* (2006.01)

(56) References Cited

U.S. PATENT DOCUMENTS

2005/0200453 A1* 9/2005 Turner ..... G07C 9/00087 340/5.61
2009/0079575 A1* 3/2009 Bouressa ..... G07C 9/00111 340/573.4
2012/0176237 A1* 7/2012 Tabe ..... A61B 5/6804 340/539.12
2012/0235477 A1* 9/2012 Korman ..... H01L 31/042 307/11
2014/0021347 A1* 1/2014 Ominami ..... H01J 37/18 250/307
2015/0051931 A1* 2/2015 Miller ..... G06Q 10/06311 705/7.15
2016/0029890 A1* 2/2016 Stump ..... A61B 5/0022 600/301

OTHER PUBLICATIONS

GB Search Report, GB Application No. GB1215760.8, dated Jan. 7, 2013.

* cited by examiner

SYSTEM FOR MONITORING EVACUATION OF A FACILITY

CROSS REFERENCE TO RELATED APPLICATIONS

The present application is a national stage entry of PCT/GB2013/052310,filed on Sep. 4, 2013, and claims priority to UK national application 1215760.8,filed Sep. 4, 2012. The full disclosures of GB application 1215760.8 and PCT/GB2013/052310are incorporated herein by reference.

This invention relates to a system for monitoring evacuation of a facility, such as an office or other building, a building site, an airport and so forth, in the event of fire, sabotage or any other real or suspected disaster.

It is known to have a personnel registration system for a facility, in which the presence of people at the facility is registered. Such a system can note the identity of the person concerned. Typically the entry of people into the facility and the exit of people from the facility can be monitored. In this manner, there is kept an up to date record of who is at the facility. Such a system can apply to an entire facility and/or to parts of the facility so that it is known in which location within the facility a person is located.

This functionality is frequently provided as part of an access control system for the facility. However, instead of an access control system or in addition to it, the functionality may be provided by an alternative or additional registration method (AARM) such as a visitor list, patient, student or guest register, crew manifest or similar. For a facility, there may be multiple systems for recording the presence of people, such as one for regular workers, one for visitors and one for people working at the facility on a temporary basis.

Typically, if there is an access control system a person will carry an RFID card or similar item which is read to identify the person at entrances, exits and areas throughout the facility, by presenting their card to a reader at these locations. Other card technologies exist including magnetic stripe, smart cards or cards printed with bar codes of various types, for example 2D and 3D. Persons may also be identified by biometric data such as fingerprint, hand-scan, retinal, or facial recognition information.

There are many ways in which the identity of a person can be identified and their presence within a facility, or in a particular part of a facility, recorded. Data is generally recorded in a data store on a server, and at any time the data can be queried to determine who is in the facility, and optionally their whereabouts in the facility.

It has been proposed that the data stored on a server such as an access control server can be accessed in the case of evacuation of a facility, so that a list can be made of those people in the facility and their evacuation monitored. If necessary, the emergency services can be given a list of those still thought to be in the facility, optionally with an indication of where they are thought to be. It has been proposed that in the event of evacuation of a facility, data concerning those within the facility can be accessed with logging units outside the facility so that at muster points the presence of people can be entered into the logging unit. In U.S. Pat. No. 7,468,658 there are provided external card readers. In the event of evacuation, data is passed from a base server at the facility to a portable computer which then communicates with the external card readers, for example wirelessly. In U.S. Pat. No. 6,956,474 there is provided a hand-portable monitoring device in the facility which is fed personnel presence information from a computer at the facility. In the event of evacuation, the portable monitoring device is taken outside the facility.

According to one aspect of the present invention, there is provided a method of monitoring the presence of personnel within a facility and of monitoring the evacuation of the facility, in which the facility has a personnel registration system that obtains data which can be used to indicate the presence of a person in the facility and stores the data on a personnel server; the method comprising:

providing an interface data processing unit that is in data communication with the personnel server and continuously receives data from the personnel server that can be used to identify people within the facility at any given time;

the interface data processing unit being in data communication with and continuously supplying data to a monitoring server which stores data identifying people within the facility at any given time;

providing a portable data processing device which is in data communication with the monitoring server and continuously receives from the monitoring server data identifying people within the facility at any given time;

upon evacuation of the facility, taking the portable data processing device to a mustering point outside of the facility, and effecting wireless data communication between the portable data processing device and the monitoring server so that the portable data processing device can continuously receive data from and send data to the monitoring server;

and during evacuation of the facility: using data input means on the portable data processing device to log the attendance of people at the mustering point; and continuously communicating to the monitoring server data identifying people logged by that portable data processing device.

With such a method, during normal use the monitoring server keeps track of which people are in the facility at any given time, and communicates that data to the portable device so that both store the data. When there is evacuation of the facility, which may be because of a real or suspected emergency or because of a drill, people who have evacuated the facility are logged into the portable device and the data on the monitoring server is updated by the portable device. Thus the monitoring server keeps an up to date record of who is present in the facility both before and during an evacuation procedure. Any changes detected by the personnel registration system, such as a person leaving, or entering, or re-entering the facility after the commencement of evacuation will be communicated to the monitoring server, and appropriate information can be fed to the portable device.

This is in contrast to systems in which the data used to monitor evacuation is static, and for example in the form of a printed list or data on a device which is taken out of a facility with a fixed list of people. Updates during the evacuation process are not taken into account. In addition, the information used by known systems is taken at a point after a fire alarm or the like has sounded and people have already started to leave the building. In the intervening period, people will already have left the building. If they have been detected as leaving the building, they will not be on the list of people that is used at the muster point, yet they will be present at the muster point. This leads to confusion. The arrangement of the present invention is such that the monitoring server holds all necessary data as at the time an alarm event is initiated which will lead to evacuation, so that everybody known to be in the building at the commencement of evacuation will be included in the data used at the muster point. This is an advantage of having the monitoring system separate from the personnel system, which is primarily concerned with controlling access to the facility and/or monitoring personnel presence for timekeeping purposes. The purpose designed and separate system of some aspects of the current invention can be configured so that it deals more effectively with the evacuation process.

The personnel server may be part of an access control system for the facility, part of a timekeeping system at the facility, or part of any system that records data indicative of whether a person is in the facility or not.

The personnel registration system may receive data indicating directly that a person has entered the facility, from an access control system.

The personnel server may hold data indicating not only whether a person is in the facility, but also the whereabouts of that person within the facility. Thus, the personnel registration system may obtain data identifying not only the entry of people into the facility but also data identifying the entry of people into a part of the facility, and may store that data on the personnel server. The monitoring server may thus receive data indicating not only whether a person is in the facility, but also the whereabouts of that person within the facility. If the personnel registration system obtains data from an access control system, the personnel registration system may obtain data identifying not only people who have been permitted access into the facility or into a part of the facility, but also data identifying people who have been refused access into the facility or into a part of the facility.

The personnel registration system may receive data indicating indirectly that a person has entered the facility, for example as a result of a person recording data on a timekeeping system, or logging on to a computer system.

The personnel registration system may also obtain from an access control system data identifying directly the egress of people from the facility, and optionally from a part of the facility, and may store that data on the personnel server. The monitoring server may thus receive data indicating whether a person has left the facility or part of the facility.

The personnel registration system may also obtain data identifying indirectly the egress of people from the facility, for example as a result of a person recording data on a timekeeping system, or logging off of a computer system. Logging out of a timekeeping system or logging off of a computer system may indicate that a person is about to leave the facility.

The manner in which it is determined whether a person is in the facility, or a part of the facility, will depend on the data that is available and may require access to multiple systems. Some access control systems will automatically note when a person enters a facility, and will automatically note when a person leaves a facility. However, some access control systems will automatically note when a person enters a facility, but will not note when a person leaves the facility. In that case, other data may be used to indicate whether a person has left. For example, logging out of the timekeeping system or logging off of a computer system may indicate that a person is about to leave the facility. Other factors may be taken into account, such as time of day, in assessing the likelihood of a person having left the facility. For example, if it is late in a day and there is no activity recorded in the facility, it may be assumed that any person who has entered the facility on that day has now left, and detection of people entering the facility can start afresh on the following day, so that persons listed as in the facility on that following day will be only persons detected on that following day. Lack of activity may be detected, for example, from lack of activity on computer workstations, or lack of people being detected by motion sensing systems, lack of lighting being made active, and any other indication that no person is present in the facility.

The monitoring server may also obtain data directly from one or more access control devices or timekeeping devices, or from an access control system or from a timekeeping system, that is not routed through the personnel server.

The interface data processing unit may be provided within the facility and may receive data from the personnel server over a local area network (LAN). However, this unit could be provided remote from the facility provided that the speed of access to the personnel server is sufficient. The interface data processing unit could be integrated into the monitoring server, although preferably it is separate as that gives the maximum flexibility.

The monitoring server could be provided within the facility, which may make it suitable for integration with the interface data processing unit. However, preferably, the monitoring server is remote from the facility, and in general with such a remote arrangement, the interface data processing unit is located within the facility. The remote monitoring server may receive data from the personnel server, via the interface unit over the Internet or a wide area network (WAN). The remote monitoring server may be provided as a "cloud" service. A first monitoring server may be backed up by replication or mirroring to a second monitoring server. The second monitoring server may be provided within the facility or may be provided at a location remote from the facility. In some embodiments the first monitoring server may be provided within the facility and the second monitoring server replicated at a location remote from the facility, for example as a "cloud" service. In such an arrangement, the first monitoring server may be provided also with a mirrored monitoring server within the facility. If additional resilience is required, the remote second monitoring server may be provided also with a mirrored monitoring server remote from the facility. Any number of backup servers, in any desired configuration, may be provided within the facility or remote from the facility, depending on the level of resilience required. In general, the monitoring server can be mirrored and/or replicated as seen fit to provide high availability and redundancy of the data it holds in the event of hardware and/or communications failure.

If the monitoring server, or a backup monitoring server, is located offsite and contains data from the personnel server that is continually being updated, then if the onsite systems are destroyed suddenly, for example as a result of an explosion, the portable device and/or an evacuation monitoring data processing terminal will be able to communicate with an offsite monitoring server and be connected to the most recent data.

The portable device may be provided with wireless network functionality so that when it is taken from the facility in the evacuation process, it can connect to the monitoring server via a wireless router. The portable device may in addition, or as an alternative, be connectible to the monitoring server over a mobile communications network (a phone network), for example using a GPRS network such as EDGE, 3G or 4G. When on standby within the facility the portable device may be docked in a charging station. When docked the portable device may connect to the monitoring server via the wireless network connection or over a mobile communications network. However, additionally or alternatively the charging station may provide a wired connection, for example to the same router that provides the Wireless network connection or to another router which connects to the Internet or a WAN, or in the case of an onsite monitoring server to the LAN to which the monitoring server is connected. In any event, when there is an evacuation process, the portable device is taken away from the facility and it connects to the monitoring server, either wirelessly, or over a mobile communications network, and preferably wirelessly with the mobile communications network as a backup in case the wireless network fails or the portable device is taken out of range.

Preferably the portable device will contain all necessary data, so that even if it is disconnected from the monitoring server because of failure of all routes of communication, or if the monitoring server (and any backup(s)) fails, the portable device can continue to record the presence of people at the muster station. When connection to an operative monitoring server is re-established, the portable device may transfer its data updates to the monitoring server.

In some embodiments of the invention an evacuation monitoring data processing terminal is provided and accesses the monitoring server so as to interrogate the data and determine the progress of evacuation. Once connected to the monitoring server, the evacuation monitor continuously receives data updates from the monitoring server. In the event that the evacuation monitoring terminal loses contact with the monitoring server or the monitoring server fails, the evacuation monitoring terminal will connect to a backup server if there is one, or possibly it could connect to the portable device so as to monitor the state of evacuation in accordance with the data on the portable device. The evacuation monitoring terminal may be provided within the facility so that personnel (perhaps in a control room) within the facility can monitor the state of progress of evacuation, or remotely from the facility for example at an emergency services site such as a fire station. Preferably a portable computer can act as the evacuation monitoring terminal so that a person within the facility can leave the facility and still monitor evacuation. The portable computer will connect wirelessly to the monitoring server, for example using wireless network and/or a mobile communication network, for example having the same connectivity as the portable device which is used to monitor attendance at a muster point.

Thus in embodiments of the invention, people do not have to remain in the facility to produce lists or to monitor evacuation. They can take the portable device, and if appropriate a portable computer used as the evacuation monitoring terminal, and leave the facility immediately an evacuation alarm is given.

The monitoring server notes when an evacuation process is initiated. This may be achieved by use of a manual operation, such as initiating sending of an evacuation signal to the monitoring server, or automatically, for example by integration with an alarm system such as a fire alarm. When an alarm status is initiated, the monitoring server notes the start of the evacuation process. A system may be provided for preventing this happening during an alarm test (but not during a fire drill in which there is to be an evacuation process).

It will be appreciated that when it is stated that a device receives data from another device, or sends data to another device "continuously", this does not mean that there is an uninterrupted flow of data between them, although that is a possibility. By "continuously", it is meant that a data update on one device results in an automatic update on the other device immediately or within a short period. For example, an update on one device may automatically trigger the sending of update data to the other device. Alternatively, one device may connect to the other device at regular intervals to look for data updates since the last time of connection, and may download such updates; or one device may connect to the other device at, preferably, regular intervals, to upload updates since the last time of connection. The intervals may for example be 1 second, or 5 seconds, or 10 seconds or any amount of time considered to be suitable. It is particularly preferred that the interface unit connects to the personnel server at intervals and queries the server to retrieve details of updates. This makes it unnecessary to interfere with the processes that happen on the personnel server, such as for example installing triggers which will cause data to be transmitted to the interface unit every time there is a change in data, or a change of data in a certain field. Although such an arrangement would be possible it could require interfering with a third party product such as an access control system.

Preferably, there is a plurality of the portable devices. Preferably each has the same functionality and preferably the same communications abilities. Preferably each one contains a full set of data. However, each may be used at a different muster station and people may be assigned to particular muster stations. Each portable device could contain data appropriate to its own muster station but preferably each portable device contains a full set of data even though there may be an option to switch between a list of people appropriate for a particular muster station and a full list or a list of people appropriate to another muster station. In this way, it is not a problem if people attend the wrong muster station and they do not have to be re-directed. In addition, if one portable device fails, another one can handle people at a combined muster station. In any event, saving a complete set of data on all portable devices provides greater resilience in the event of failure of any one of them.

The plurality of portable devices may communicate with each other directly. Data updates as a result of people being logged at a remote device may be communicated between the remote devices directly, as well as being communicated to the monitoring server.

Logging of a person on a portable device may be by any convenient means. There may be a list of people displayed, on which is marked the attendance of a person at the muster station. Alternatively, if an access control system or time recording system uses a reader which records the presence of a person, a corresponding reader may be provided for the portable device, either integrated within it or connected to it. Such a reader could for example read a card wirelessly, for example using RFID technology or could read other types of card including those with magnetic stripes, or cards printed with bar codes of various types. The reader could also read biometric data such as fingerprints, hand-scans, or retinal scans, or could use facial recognition information to identify a person. Since a person may not have a card, may have lost a card or may have been injured making biometric data scanning unsuitable, there may be an alternative method of data entry such as a keypad or a list, to identify the person and record their presence at the muster station.

In preferred embodiments of the invention, recognising existing security tokens from other systems is advantageous, such as reading cards from an access control system which is already deployed by a company. Data can be stored and encrypted in different ways on those tokens but in the preferred embodiment there is flexible software to adjust to many different tokens/card formats, to avoid having different tokens for security and for evacuation.

Where there is a backup monitoring server, a portable device may receive data from and communicate data to the backup server in the event that communication with the primary monitoring server is lost. Communication may be lost for various reasons such as a communications failure or failure of the primary server. In some cases there could be problems if communication with the primary server is re-established, as there will be various versions of the data which will have to be reconciled. In one arrangement therefore, if a portable device loses contact with the primary server and there is a backup server, the device switches permanently to the backup server and communicates this decision to any other portable device, which does the same, so that a consistent set of data is being used. The same applies to an evacuation monitoring terminal. If the evacuation monitoring data terminal itself notes that the primary monitoring server is unavailable, it will perform a switch and notify the portable devices.

In the event that there is failure of the monitoring server and there is either no backup server or that fails also, in some embodiments the portable devices can cooperate to keep updated data and to provide updated data to an evacuation monitoring terminal.

In addition to a portable device there may be a remote device mounted permanently at a muster station. Such a remote device would have the same functionality as a portable device as described above, and the same communications possibilities, save that in addition to or instead of wireless communications there may be a wired connection for the remote device.

In accordance with another aspect of the invention, a remote device is used in place of a portable device. Thus, viewed from another aspect, the invention provides a method of monitoring the presence of personnel within a facility and of monitoring the evacuation of the facility, in which the facility has a personnel registration system that obtains data which can be used to indicate the presence of a person in the facility and stores the data on a personnel server; the method comprising:

providing an interface data processing unit that is in data communication with the personnel server and continuously receives data from the personnel server that can be used to identify people within the facility at any given time;

the interface data processing unit being in data communication with and continuously supplying data to a monitoring server which stores data identifying people within the facility at any given time;

providing a remote data processing device which is in data communication with the monitoring server and continuously receives from the monitoring server data identifying people within the facility at any given time, the remote device being at a mustering point outside of the facility;

upon evacuation of the facility, effecting communication between the remote data processing device and the monitoring server so that the remote data processing device can continuously receive data from and send data to the monitoring server;

and during evacuation of the facility: using data input means on the remote data processing device to log the attendance of people at the mustering point; and continuously communicating to the monitoring server data identifying people logged by that remote data processing device.

Viewed from another aspect, the invention provides a method of monitoring the presence of personnel within a facility and of monitoring the evacuation of the facility, in which the facility has a personnel registration system that obtains data which can be used to indicate the presence of a person in the facility and stores the data on a personnel server; the method comprising:

providing an interface data processing unit that is in data communication with the personnel server and continuously receives data from the personnel server that can be used to identify people within the facility at any given time;

the interface data processing unit being in data communication with and continuously supplying data to a monitoring server which stores data identifying people within the facility at any given time;

providing a remote or portable data processing device which is in data communication with the monitoring server and continuously receives from the monitoring server data identifying people within the facility at any given time;

upon evacuation of the facility, effecting communication between the remote or portable data processing device and the monitoring server so that the remote or portable data processing device can continuously receive data from and send data to the monitoring server;

and during evacuation of the facility: using data input means on the remote or portable data processing device at a mustering point outside the facility to log the attendance of people at the mustering point; and continuously communicating to the monitoring server data identifying people logged by that remote or portable data processing device.

All of the optional features discussed above, or below, in relation to a method using a portable data processing device, apply equally to a method using a plurality of portable devices, or a remote data processing device, or a plurality of remote data processing devices, or a mixture of portable and remote data processing devices including a single portable and a single remote device or a plurality of one or both types of device.

In some cases when a facility is being evacuated, not everybody listed as being in the facility turns up at a muster point. There may be an error in the information if, for example, they had already left the facility but did not use their card to do so, perhaps leaving with somebody else. They may have decided to go somewhere else, for example if they were about to leave on a business trip, and overlooked the need to assemble at a muster station. To deal with this, the monitoring server could collate a list of people listed as being in the facility but not listed as having left it, either on exit or at a muster station.

A message would then be sent to those people using details stored on the monitoring server. A message could be, for example, an SMS text message, or an email, particularly if a person has a portable business email device such as a Blackberry™ or mobile telephone with email capabilities. There could be an automated response option, such as a code to use in a reply SMS message, or a link in an email, to indicate to the operators of the system that the person concerned is safely out of the facility. The system could then list them automatically as being safe, or could maintain their status as whereabouts unknown. If a person does not respond, there could be an option to send a follow up message to, for example, co-workers, other associates or next of kin of the person, asking for information about the person. Again, there could be an automated response option. Ultimately a message could be sent to all persons at the facility to ask for information about the missing person. In general, the system will collate responses to messages and will update a list of people unaccounted for. The emergency service will be given a list of people thought to be in the facility but not yet accounted for, to enable them to search through likely places in the facility.

An issue may arise if there is any appreciable delay between the start of an emergency and the production of a list of UNSAFE personnel. There may be people who check out of the facility during this delay period and they will be registered as absent from the facility at the time of production of the UNSAFE list and thus will not be included on that list. They will therefore be considered "safe", when in fact, they may still be UNSAFE. For example, a person may use a card to swipe out of an office after an emergency has started and will still be in, or in the vicinity of, the building. As that person is not on the UNSAFE list, if the person is injured or trapped in the building there will be no reason to suspect they are in danger if they do not turn up at a muster point. Similarly, if such a person does appear at a muster point, because they realise that there is an emergency, they will be unexpected, which complicates the mustering process. Also if such a person re-enters a facility they may be UNSAFE but again not appear on the UNSAFE list, because the UNSAFE list has already been compiled.

In a preferred embodiment of the invention, this problem is dealt with by the monitoring server and the portable device having a continuous and current up to date list of employees that are in or outside of the facility, based on information received from the personnel registration system. Thus any delay in producing the UNSAFE list by the personnel registration system is circumvented. Updates that are received from the personnel registration system regarding persons leaving or entering the facility after the emergency has begun will update the UNSAFE list.

The functionality of the monitoring servers is focussed on detecting people who may be at-risk, and they can have capabilities that would not be part of a conventional personnel registration system such as an access control system or an AARM.

In preferred embodiments of the invention there is effectively a "Live Roll Call" which has feeds from existing access control systems and from portable devices. Input from all of them together is assembled to give current up to date output. This is an alternative to a static printed roll call which does not change after printing. The "Live Roll Call" changes all the time, before evacuation and when it is in progress, and is always up to date.

Preferred embodiments of the invention provide a unique way of connecting to existing access control systems and recognising the location of a person regardless of whether access was granted or denied when access was attempted using a card, for example. This is subject to the required abilities of the associated access control system. For example when a person goes through an in-bound door after another person, without using a security token and without being noticed by the access control system, that person is not noted by the access control system as being within the facility. Furthermore, if that same person later uses the token to enter part of the facility but gets access denied, the access control system may still not note that person as being present in the facility at all. In contrast, by noting "access denied" events within the facility, a system operating in accordance with the present invention can note that person may be in the facility even if the access control system has not recorded them as being in the facility. This is another advantage of having a monitoring server that is separate from the access control system and can make its own interpretation of events recorded by the access control system.

In preferred embodiments of the invention, there is provided the ability to expand the functionality of existing systems. Personnel can be added, readers can be added, areas can be added, and muster points can be added. For example if an access control system does not support the division of a facility into areas, they can be created and connected to readers, if appropriate to readers already existing in that system. The additional functionality can then be added directly to the monitoring server.

The method in accordance with the invention allows a number of risk scenarios to be analysed. For example there can be different interpretation of events which happened before evacuation started and after. For example a person leaving a site before evacuation commences is just "off site". But when the same happens after evacuation starts the person is not considered to be "off site" but is expected to appear at a muster point and is present on the list of unsafe people.

In some embodiments of the invention, the following logic may be used (the start of the evacuation is called the EVACUATION START):

A person may be considered to be in an UNSAFE state if:

1. The person is not listed as having left the facility, and has not registered on a portable device.
2. The person is listed as having left the facility, but either
   a) left after the EVACUATION START,
   orb) left before the EVACUATION START, but at a point in time too close to the EVACUATION START for the person to be assumed to have reached safety before the EVACUATION START and has not registered on a portable device.
3. The person is not listed as having left the facility but registered on a portable device before the EVACUATION START.

A person may be considered to be in a SAFE state if:

The person registered on a portable device after the EVACUATION START, regardless of whether they were listed as being within the facility.

A person cannot be in a SAFE state unless they were first in an UNSAFE state.

Persons who are in neither a SAFE state nor an UNSAFE state are considered to be in an UNLISTED state.

It will be appreciated that where there is a remote monitoring server, this may be located anywhere, and indeed anywhere in the world and in a different country to the facility. The methods in accordance with the invention involve steps of sending data to the monitoring server and receiving data from the monitoring server, regardless of where the monitoring server is located.

Viewed from another aspect the invention provides a data processing system for monitoring the presence of personnel within a facility and for monitoring the evacuation of the facility, in which the facility has a personnel registration system that obtains data which can be used to indicate the presence of a person in the facility and stores the data on a personnel server; the system comprising:

an interface data processing unit that is in data communication with the personnel server and continuously receives data from the personnel server that can be used to identify people within the facility at any given time;

the interface data processing unit being in data communication with and continuously supplying data to a monitoring server which stores data identifying people within the facility at any given time;

a portable data processing device which is in data communication with the monitoring server and continuously receives from the monitoring server data identifying people within the facility at any given time; the portable data processing device being adapted to be taken to a mustering point outside of the facility, and being provided with wireless data communication between the portable data processing device and the monitoring server so that the portable data processing device can continuously receive data from and send data to the monitoring server when at the mustering point; the portable data processing device having data input means to log the attendance of people at the mustering point; and being adapted to continuously communicate to the monitoring server data identifying people logged by that portable data processing device.

Viewed from another aspect the invention provides a data processing system for monitoring the presence of personnel within a facility and for monitoring the evacuation of the facility, in which the facility has a personnel registration system that obtains data which can be used to indicate the presence of a person in the facility and stores the data on a personnel server; the system comprising:

an interface data processing unit that is in data communication with the personnel server and continuously receives data from the personnel server that can be used to identify people within the facility at any given time;

the interface data processing unit being in data communication with and continuously supplying data to a monitoring server which stores data identifying people within the facility at any given time;

a remote data processing device which is in data communication with the monitoring server and continuously receives from the monitoring server data identifying people within the facility at any given time, the remote device being at a mustering point outside of the facility;

the remote data processing device having data input means to log the attendance of people at the mustering point; and being adapted for continuously communicating to the monitoring server data identifying people logged by that remote data processing device.

Viewed from another aspect the invention provides a data processing system for monitoring the presence of personnel within a facility and for monitoring the evacuation of the facility, in which the facility has a personnel registration system that obtains which can be used to indicate the presence of a person in the facility and stores the data on a personnel server; the system comprising:

an interface data processing unit that is in data communication with the personnel server and continuously receives data from the personnel server that can be used to identify people within the facility at any given time;

the interface data processing unit being in data communication with and continuously supplying data to a monitoring server which stores data identifying people within the facility at any given time;

a remote or portable data processing device which is in data communication with the monitoring server and continuously receives from the monitoring server data identifying people within the facility at any given time, the remote or portable device being usable at a mustering point outside of the facility;

the remote or portable data processing device having data input means to log the attendance of people at the mustering point; and being adapted for continuously communicating to the monitoring server data identifying people logged by that remote or portable data processing device.

The interface data processing unit may receive data from a plurality of sources. For example there could be an access control server and a separate server that keeps track of visitors to the facility. There could be multiple parts of a facility, governed by multiple access control servers. In some embodiments a single interface data processing unit will gather data from all relevant sources, if necessary collate the data, and will transmit the data to the monitoring server.

The monitoring server could keep records of data from multiple sites and could provide different sites with the data relevant to the portable/remote devices at those sites.

It will be appreciated that whilst in some embodiments of the invention the interface data processing unit is separate from the personnel server, it could be integrated into the personnel server, and in this case, suitable hardware and/or software would ensure that the required data is sent continuously to the monitoring server.

Viewed from another aspect, the invention provides a method of monitoring the presence of personnel within a facility and of monitoring the evacuation of the facility, in which the facility has a personnel registration system that obtains data which can be used to indicate the presence of a person in the facility and stores the data on a personnel server; the method comprising:

the personnel server being directly or indirectly in data communication with and continuously providing data, directly or indirectly, to a monitoring server which stores data identifying people within the facility at any given time;

providing a portable and/or remote data processing device which can be taken to, or is situated at, a mustering point outside of the facility, the data processing device being in data communication with the monitoring server and continuously receiving from the monitoring server data identifying people within the facility at any given time, both before and during evacuation of the facility;

and during evacuation of the facility: using data input means on the data processing device at the mustering point to log the attendance of people at the mustering point; and continuously communicating to the monitoring server data identifying people logged by that data processing device.

The personnel server could be located remotely, and receive data from at least one access control device at the facility, or from at least one timekeeping device or from an access control system or from a timekeeping system at the facility.

The functions of the personnel registration system and the monitoring server could be combined. Thus, viewed from another aspect, the invention provides a method of monitoring the presence of personnel within a facility and of monitoring the evacuation of the facility, in which the facility has a personnel registration system that obtains data which can be used to indicate the presence of a person in the facility and stores the data on a server; the method comprising:

providing a portable and/or remote data processing device which can be taken to, or is situated at, a mustering point outside of the facility, the data processing device being in data communication with the server and continuously receiving from the server data identifying people within the facility at any given time, both before and during evacuation of the facility;

and during evacuation of the facility: using data input means on the data processing device at the mustering point to log the attendance of people at the mustering point; and continuously communicating to the server data identifying people logged by that data processing device.

The server may obtain data directly from one or more access control devices or timekeeping devices, or from an access control system or from a timekeeping system.

In one possible arrangement, the server is provided at a remote location. The server may obtain data from at least one access control device at the facility and/or from at least one timekeeping device at the facility and/or an access control system at the facility and/or from a timekeeping system at the facility.

When the expression "server" is used in this specification, it does not imply that there is a single physical device. A server could comprise a plurality of data processing units. Additionally, a single physical device could host a plurality of servers.

Some embodiments of the invention will now be described by way of example and with reference to the accompanying drawing, in which.

Figure 1:
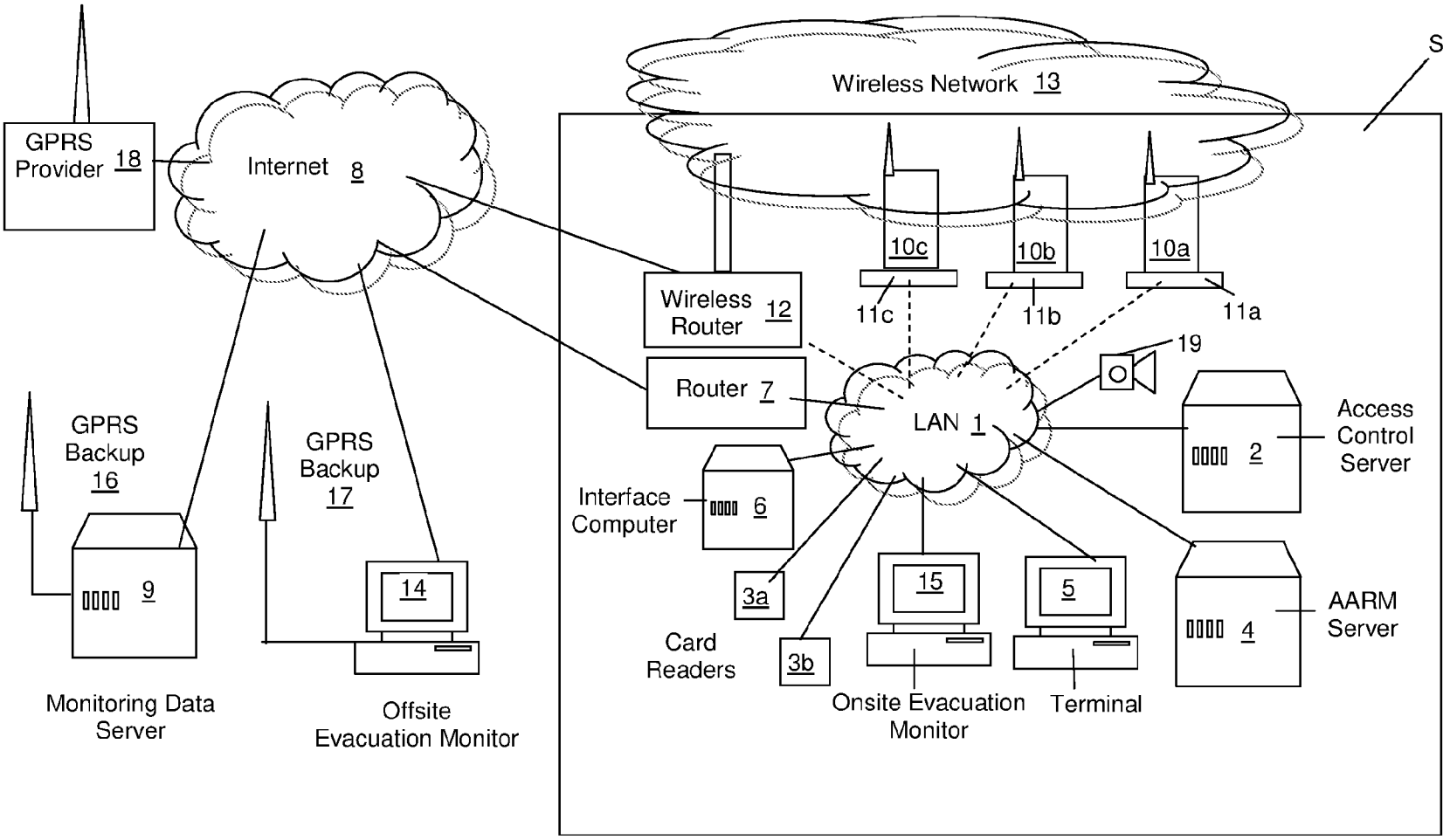
FIG. 1 shows in diagrammatic form a system in accordance with the invention.

Referring now to the drawing, there is a facility S, which may for example be an office building, factory site, school and so forth. At this facility is a local area network (LAN) 1. In this embodiment the various components are connected together via the LAN but devices could be connected together directly, or through multiple LANs.

Connected to the LAN 1 is an access control server 2 which connects to a plurality of card readers 3*a* and 3*b* controlling access to the facility or parts of the facility by way of RFID cards carried by people. The access control server records events such as a person being granted access to the facility, a person leaving the facility and a person being refused access to the facility or part of the facility. Also provided is an AARM server 4, which in this case stores access information for visitors to the facility by means of a receptionist using a terminal 5. Both the access control server and the AARM server store data on databases which can be queried in a standard or non-standard manner, for example using SQL (structured query language).

An interface computer 6 communicates with the access control server and the AARM server, and obtains data from them. Initially the interface computer obtains a full set of required data, and then it queries the databases at regular intervals, say one second intervals, to identify updates to data made in the intervening period. The interface computer may collate or otherwise treat the data, and then using a router 7 which is accessed via the LAN 1 and is connected to the Internet 8, transmits this data to a monitoring server 9, which stores data identifying people who are present, or have been present, at the facility. This monitoring server is the primary source of staff location data for evacuation purposes.

A number of portable data processing devices, in this case three devices 10*a*, 10*b* and 10*c*, are provided. As shown, they are all located within the boundaries of the facility S on docking stations 11*a*, 11*b* and 11*c*. The docking stations may provide power to charge the batteries of the portable devices, and optionally a wired Ethernet connection to the LAN as indicated by the dotted line.

A wireless router 12 connected to the Internet 8 provides a wireless network 13 which in this embodiment operates both within the boundaries of the facility S and outside the boundaries for a certain distance. This is the primary source of wireless connectivity for the portable data processing devices 10*a*, 10*b* and 10*c*, all of which include wireless network functionality. The wireless router 12 may optionally be connected to the LAN as shown by the dotted line. This provides an alternative route of communication to the portable data processing devices 10*a*, 10*b* and 10*c* when they are on their docking station. It can also provide a backup for the main router 7 which is used by the interface computer 6.

The monitoring server 9 continuously updates the portable devices 10*a*, 10*b* and 10*c* with data concerning the presence of people at the site.

An offsite evacuation monitor 14 is provided, in the form of a desktop or portable laptop computer running monitoring software to monitor the evacuation process. The monitoring server 9 and the offsite evacuation monitor 14 could be at the same location and linked by a local area network, but in this case they are at different locations and linked via the Internet 8. There may be more than one offsite evacuation monitor computer, at different locations. An onsite evacuation monitor 15 is also provided, and this is connected to the monitoring server 9 via the LAN 1, router 7 and the Internet 8. Either evacuation monitor can be the primary source of staff location data for rescue services such the ambulance, fire or police services. There may be more than one onsite or evacuation control centre which could be located in the same or different control rooms on the site S or at different offsite locations, each provided with an evacuation monitor.

A mobile telephone network provider 18 is also connected to the Internet 8. The portable devices 10*a*, 10*b* and 10*c* also have cellular telephone interface functionality and can transmit and receive data over the Internet 8. The monitoring server 9 and the offsite evacuation monitor are also provided with cellular telephone interfaces 16 and 17, as a backup in case the primary lines of communication are interrupted.

A fire alarm 19 is provided in the facility S. This is connected to the LAN 1, so that it can communicate with other alarms, smoke and flame detectors and so forth. When an alarm is triggered, then if possible, the interface computer detects this event and communicates it to the monitoring server 9. Otherwise, the alarm event must be conveyed in some other manner, perhaps manually, to the monitoring server 9. Once notified, the monitoring server 9 records immediately that an evacuation event has commenced and if appropriate communicates this to the portable devices. The monitoring server continues to receive data updates from the interface computer which is connected to the access control server and the AARM. However, the monitoring server applies its own logic to the data supplied. For example, the monitoring server records the status of every person in the facility at the time that it recorded that the evacuation event had commenced. All persons in the facility at that time are expected to appear at a muster point even if those people left the facility, and the access control server has noted that the people have left the facility, before the mobile devices 10*a*, 10*b*, 10*c* have started to be used.

Figure 2:
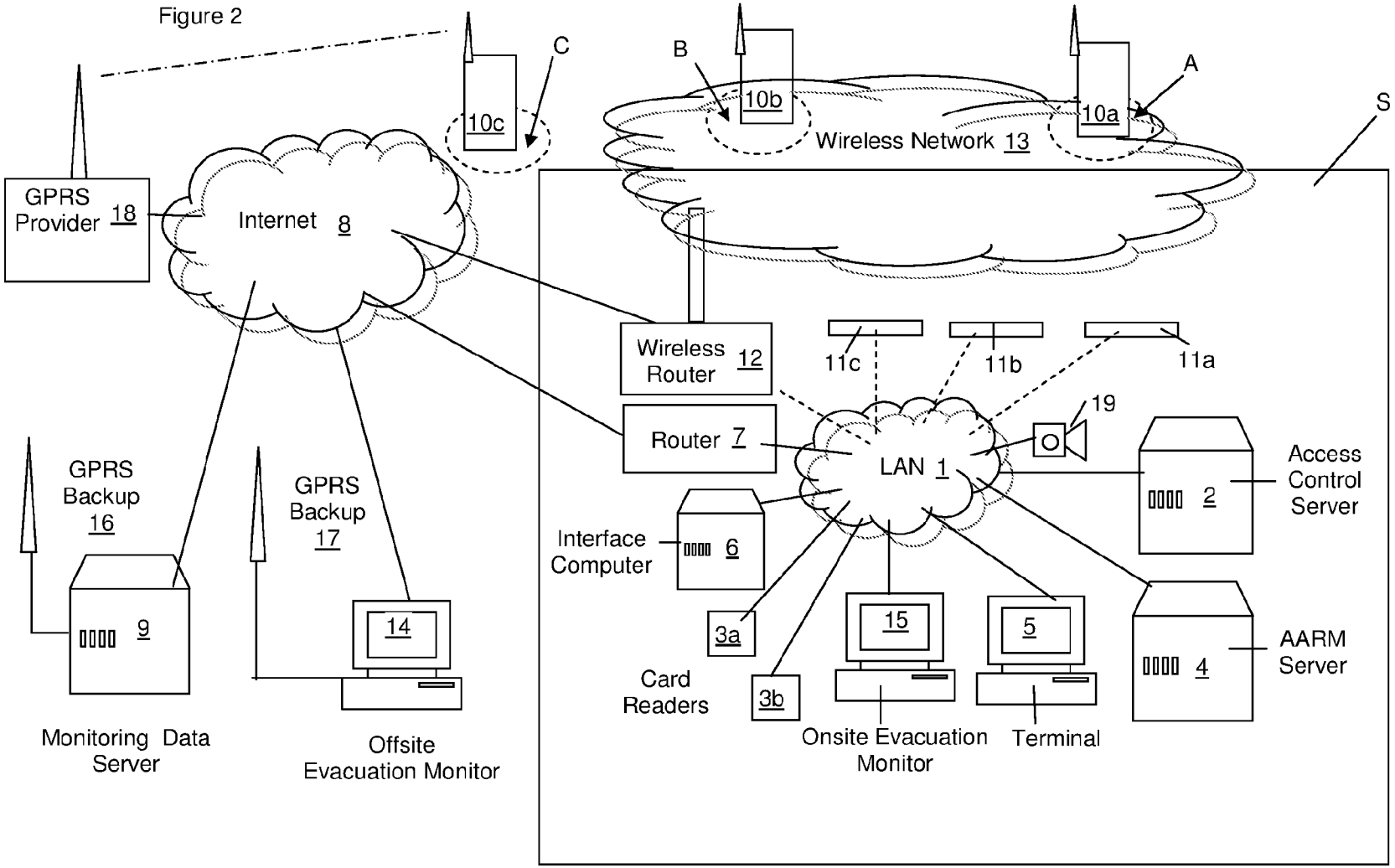
FIG. 2 shows the system of FIG. 1 after an evacuation event has occurred.

As shown in FIG. 2, at a point in time after the fire alarm 19 has sounded, the portable devices 10*a*, 10*b*, 10*c* are removed from their docking stations and taken outside the facility to respective muster zones A, B and C. These muster zones are safe areas outside the facility, such as open spaces, car parks and so forth. Portable devices 10*a* and 10*b* are still within range of the wireless network 13 and communicate with the monitoring server 9 via the wireless router 12 in the normal way. Portable device 10*c* is outside the range of the wireless network 13 but uses its mobile communications facility to connect to the mobile phone network and thence to the Internet and the monitoring server. The portable devices are continuously updated by the monitoring server, so that lists of people expected at the mustering points are kept up to date.

The portable devices 10*a*, 10*b*, 10*c* are provided with card readers so that they can also read the cards used by the access control system. People arriving at the muster stations are identified using their cards. People without cards are identified on a list displayed on a screen, and noted as having attended the muster zone. Data about people who have attended the muster zones is continuously transmitted from the portable devices to the monitoring server, and updated data is transmitted back to the portable devices and made available to the evacuation monitors.

At least some of the portable devices could be provided at muster stations within a site, where people will muster in the event that there has to be an evacuation of a facility. For example, a site could include buildings and open spaces, and muster points could be in the open spaces. In this embodiment, which is by way of example only, all of the muster points are outside the facility and one of them is outside the range of the wireless network.

Each portable device could stream information live to the other portable devices at different muster points, but preferably everything is done through the monitoring server.

In the present embodiment, one of the three muster points is outside the range of the wireless network 13. Even for muster points which are within the range of the wireless network 13, that wireless network could fail. In either case, if the portable devices are unable to communicate with the monitoring server effectively, data updates are communicated between the devices and the monitoring server via the mobile communications network. If the portable devices are unable to communicate with the monitoring server 9 or a backup, then they will store the data they capture locally until connectivity is restored. They may share the data locally with each other.

The portable devices can form a peer to peer network for the sharing of data, for example if they are all connected to the wireless network or cellular network.

In the preferred embodiments the monitoring server is hosted in a "cloud" to which the other devices can obtain access over the internet. The portable devices can access the internet using the wireless network or the mobile communications network. In general, the portable devices will use the strongest link to access data, whether the wireless network or the mobile communications network.

Evacuations of a site will be required in response to different threats, such as Fire, Toxic Gas Release, Flammable Gas Release, Hazardous Liquid Spill, Bomb, Oil Spill, Radiation Leak, Flood, or in response to a combination of two or more of these such as, for example, Fire & Toxic Gas Release. The following procedure deals with evacuations where there are multiple threats.

An evacuation will begin by the system starting one or more evacuation types, which depend on the threat or combination of threats involved. If any additional threats are identified subsequently, the number of evacuation types can be extended. Similarly, if a threat no longer applies, the evacuation type for that threat can be ended. When there are no longer any evacuation types that apply, the evacuation ends.

Each evacuation type is linked to one or more Muster Points on the basis that these are considered to be safe places with regard to the threat(s) of this evacuation type. A Muster Point can be a safe place for none, one or multiple evacuation types that are started.

When an evacuation is either extended or reduced, the safety status of all Muster Points and all evacuees is re-evaluated. this is because both Muster Points and Evacuees who were previously safe may now be unsafe, or vice versa. The new safety status (either safe or unsafe) of all Muster Points and Evacuees is then sent to all devices.

One or more devices can start one or more evacuation type(s) simultaneously, which results in a multi-threat evacuation on all devices. For example, device 1 could start an evacuation type of "Fire", and device 2 could start an evacuation type of "Toxic Gas". The result will be a multi-threat evacuation for all devices, and the only safe Muster Points will be those considered safe for both "Fire" and "Toxic Gas", and all other Muster Point would be considered unsafe.

When a device starts, extends, reduces or ends an evacuation, and the device is "offline" (e.g., it is unable to connect to the server), the message is delayed, and the device sends the message as soon as it regains connectivity. During this "offline period", the state of the evacuation could have changed (i.e., it could have been started, extended, reduced or ended) by other devices. When the delayed message is received by the server, the server either actions the evacuation change or ignores it. For example, the delayed message may be ignored after the sequence of events in the following example:

An offline device 1 starts an evacuation of evacuation type "Fire", but because it was offline, the message could not be sent to the server.

While device 1 is still offline, an online device 2 starts an evacuation of the same evacuation type, "Fire".

Later on, while device 1 is still offline, the evacuation of evacuation type "Fire" is ended.

Then device 1 comes online, and sends its delayed message to try to start the evacuation of evacuation type "Fire", as per a) above.

Device 1's delayed message will be rejected because it is older than messages from other devices which ended an evacuation with the same evacuation type "Fire".

However, as an added precaution, device 1 can still "refuse" to end the evacuation type "Fire". It can do this because of an evacuation type end countdown, which began when it regained connectivity and learned that the evacuation had been ended by the online devices. The evacuation type end countdown provides a time interval during which this decision can be taken and the evacuation type end refusal message can be sent.

An evacuation type can be ended by any device. When a device ends an evacuation type, it triggers the evacuation type end countdown on all other devices. During the countdown, any device can decide to signal that it "refuses" to end the evacuation type. This signal is called the evacuation type end refusal, and it means that the signalling device believes that the threat(s) persist. If the evacuation type end refusal message is sent, the evacuation type is restarted. If no device sends the evacuation type end refusal, the evacuation type remains ended.

If a device is offline when the server signals that an evacuation type has ended, then the device will start its evacuation type end countdown as soon as it goes online. This means that its countdown is started later than on other devices. If the device then signals an evacuation type end refusal, then the evacuation type is restarted.

As each evacuee presents himself or herself to a device (connected to the server) at one of the safe Muster Points, the device notifies the server of the updated safe status of that particular evacuee. When the server receives this status update, it sends an acknowledgement "receipt" to the device. If the device does not receive this receipt, then in all likelihood, the updated safety status was not received by other devices, meaning that the other devices do not (yet) know that the evacuee is safe.

It will thus be seen that in the preferred embodiments there is provided a system for monitoring the evacuation of a facility, in which the facility is provided with an access control system including an access control data processing unit that receives data concerning the entry of people into the facility and the egress of people from the facility, and the facility is further provided with a monitoring server that is in data communication with the access control data processing unit and receives and stores data identifying people within the facility at any given time, the system further comprising a remote device that is at, or can be taken to, a muster station which is outside the facility, the remote device being communicable with the monitoring server and being used to log the presence of people at the muster station.

What is claimed is:

1. A method of monitoring the presence of personnel within a facility and of monitoring the evacuation of the facility, in which the facility has a personnel registration system that obtains data which can be used to indicate the presence of a person in the facility and stores the data on a personnel server; the method comprising:

providing an interface data processing unit that is in data communication with the personnel server and continuously receives data from the personnel server that can be used to identify people within the facility at any given time;

the interface data processing unit being in data communication with and continuously supplying data to a monitoring server which stores data identifying people within the facility at any given time, the monitoring server being located remotely from the facility;

providing a remote or portable data logging and processing device which is in data communication with the monitoring server and continuously receives from the monitoring server data identifying people within the facility at any given time;

upon evacuation of the facility, using the remote or portable data logging and processing device at a mustering point outside of the facility, and effecting wireless data communication between the remote or portable data logging and processing device and the monitoring server so that the portable data logging and processing device can continuously receive data from and send data to the monitoring server;

and during evacuation of the facility: using data input means on the remote or portable data logging and processing device to log the attendance of people at the mustering point; and continuously communicating to the monitoring server data identifying people logged by that remote or portable data logging and processing device; and the remote or portable data logging and processing device continuously receiving from the monitoring server updated data concerning the list of people expected at the mustering point.

2. A method as claimed in claim l, wherein the interface data processing unit is located within the facility.

3. A method as claimed in claim 1, wherein the monitoring server updates the remote or portable data logging and processing device during evacuation of the facility.

4. A method as claimed in claim 1, wherein there is provided an evacuation monitoring terminal which communicates with the monitoring server and is used to check for persons who were expected to attend the mustering point but who have not been recorded as having attended the mustering point.

5. A method as claimed in claim 4, wherein the remote or portable data logging and processing device is also communicable with the evacuation monitoring terminal.

6. A method as claimed in claim 1 wherein the remote or portable data logging and processing device communicates with the monitoring server by means of a wireless network and/or a wireless mobile communications network.

7. A method as claimed in claim 1, wherein the remote or portable data logging and processing device is provided removably on a charging station within the facility, and is taken to the mustering point in the event of evacuation of the facility.

8. A method as claimed in claim 1 wherein the personnel registration system comprises an access control system.

9. A method as claimed in claim 8, wherein the access control system controls the entry of a person into the facility by means of a token carried by the person which is read electronically by a token reader at the facility, and the remote or portable data logging and processing device is provided with a token reader to read a token carried by a person in order to record data indicating that the person has attended the mustering point.

10. A method as claimed in claim 8, wherein the access control system controls the entry of a person into the facility by means of biometric scanning and the remote or portable data logging and processing device includes a biometric scanner for identifying a person in order to record data indicating that the person has attended the mustering point.

11. A method as claimed in claim 1, wherein there is a plurality of the remote or portable data logging and processing devices, each of which is in communication with the monitoring server.

12. A method as claimed in claim 11, wherein the plurality of remote or portable data logging and processing devices are in wireless communication with each other.

13. A method as claimed in claim 12, wherein the remote or portable data logging and processing devices are in wireless communication with each other by means of a wireless a network and/or a wireless mobile communications network.

14. A method as claimed in claim 11, wherein each remote or portable data logging and processing device is located at a different mustering point.

15. A method as claimed claim 14, wherein each person is assigned to a specific mustering point.

16. A method as claimed in claim 1 wherein commencement of evacuation is initiated by an alarm system which triggers the monitoring server to record that an evacuation event has commenced.

17. A method as claimed in claim 16, wherein after the evacuation event has commenced, if a person is detected by the personnel registration system as having left the facility, that person is treated by the monitoring server as being expected to attend the mustering point.

18. A method as claimed in claim 1, wherein the monitoring server is mirrored or replicated by a backup server.

19. A method as claimed in claim 1 wherein in the event that a person expected to attend the muster station is unaccounted for, a message will be sent to that person and/or to other persons, seeking information as to the location of that person.

20. A method as claimed in claim 19, wherein responses to messages are collated and a list of people not accounted for updated in accordance with information received.

21. A method as claimed in claim 1, wherein the interface data processing unit queries the personnel server at intervals to obtain updated data.

22. A method as claimed in claim 1 wherein the interface data processing unit continuously receives data from the personnel server and continuously supplies data to the monitoring server, both before and during evacuation of the facility.

23. A method as claimed as claimed in claim 1, wherein there is also provided a remote or portable data logging and processing device which is situated at a mustering point remote from the facility, the remote or portable device being in data communication with the monitoring server and continuously receiving from the monitoring server data identifying people within the facility at any given time;

upon evacuation of the facility, effecting communication between the remote or portable data logging and processing device and the monitoring server so that the remote data logging and processing device can continuously receive data from and send data to the monitoring server; and using data input means on the remote or portable data logging and processing device at the mustering point to log the attendance of people at the mustering point; and continuously communicating to the monitoring server data identifying people logged by that remote or portable data logging and processing device.

24. A method of monitoring the presence of personnel within a facility and of monitoring the evacuation of the facility, in which the facility has a personnel registration system that obtains data which can be used to indicate the presence of a person in the facility and stores the data on a personnel server; the method comprising:

providing an interface data processing unit that is in data communication with the personnel server and continuously receives data from the personnel server that can be used to identify people within the facility at any given time;

the interface data processing unit being in data communication with and continuously supplying data to a monitoring server which stores data identifying people within the facility at any given time, the monitoring server being located remotely from the facility;

providing a remote or portable data logging and processing device which is in data communication with the monitoring server and continuously receives from the monitoring server data identifying people within the facility at any given time;

upon evacuation of the facility, effecting communication between the remote or portable data logging and processing device and the monitoring server so that the remote or portable data logging and processing device can continuously receive data from and send data to the monitoring server; and during evacuation of the facility: using data input means on the remote or portable data logging and processing device at a mustering point outside the facility to log the attendance of people at the mustering point; and continuously communicating to the monitoring server data identifying people logged by that remote or portable data logging and processing device; and the remote or portable data logging and processing device continuously receiving from the monitoring server updated data concerning the list of people expected at the mustering point.

* * * * *